United States Patent [19]

Meade

[11] 4,258,735

[45] Mar. 31, 1981

[54] STEP ASSISTING DEVICE

[76] Inventor: Charles P. Meade, 2550 Pacific Coast Hwy., #197, Torrance, Calif. 90505

[21] Appl. No.: 162,167

[22] Filed: Jun. 23, 1980

[51] Int. Cl.[3] ..... A45B 1/00

[52] U.S. Cl. ..... 135/65

[58] Field of Search ..... 135/65, 66, 77, 79, 135/84

[56] References Cited

U.S. PATENT DOCUMENTS

| | | | |
|---|---|---|---|
| 2,642,074 | 6/1953 | Pedley | 135/65 |
| 2,782,796 | 2/1957 | Blue | 135/65 |
| 3,273,575 | 9/1966 | Aldrich | 135/84 |
| 3,738,674 | 6/1973 | Pauls | 135/66 |
| 3,906,971 | 9/1975 | Burnstine | 135/65 |

*Primary Examiner*—Reinaldo P. Machado
*Attorney, Agent, or Firm*—Singer & Singer

[57] ABSTRACT

A substantially rectangular member is removably attached to a walking stick such as a cane at the lower extremity. The member is adapted to pivot from a horizontal to a vertical position about the cane but not through the cane and in such a way that with the member in the vertical position the bottommost portion of the walking stick is exposed whereas with the member in the horizontal position the bottommost portion of the walking stick is not exposed thereby allowing the user to step on the horizontal member when climbing steps.

7 Claims, 7 Drawing Figures

STEP ASSISTING DEVICE

This invention relates to a device adapted to be attached to a walking stick and more particularly to a device that can be removably attached to a walking stick or cane without disfiguring the cane and which allows the user a convenient means to climb or descend steps that could not normally be manipulated because of the height of the riser.

The normal riser in step construction is approximately seven to eight inches which means the average person must have the capability of lifting each foot at least that amount in order to climb or descend steps.

Unfortunately, older people or people with hip deformities or other locomotion problems have problems in raising their foot the necessary seven to eight inches in climbing or descending steps. It is for this reason that many homes for the elderly and infirm use inclined planes in order to assist these physically handicapped persons. The problem is also receiving wide assistance from the State and Federal governments who now recognize the problem and are placing incline planes at the curbs in many streets in our local cities.

Unfortunately these solutions are temporary because of the problem of steps placed in buildings of one or two stories in height that do not lend themselves for the construction of elevators or inclined planes. The handicapped person must either be lifted or must forego whatever business or social engagements that may take place where steps must be transcended.

This invention is concerned with a step assisting device capable of being carried by the person themselves on a cane or walking stick and which allows the user to place a solid member of approximately $3\times4\times6$ inches dimension on the step and which has the effect of reducing the height of the riser in half. The disabled person then steps on the block with one foot and since the block has a height of substantially three inches, it is only necessary for the foot of the user to transcend only half of the height of the riser.

In this fashion the user steps on the block and then on the next step and after safely on the step above, picks up the cane with the attached block and places it on the step above and in this way the user can either climb or descend steps that would otherwise not be available to him in the past.

In the past the problem has been recognized as evidenced by U.S. Pat. No. 2,782,796 issued to M. S. Blue on Feb. 26, 1957.

The Blue patent recognizes the general problem of providing the user with a flat block to reduce the height of the riser but unfortunately the stepping block is fixedly attached to a walking aid that can only be used as a walking aid and not as a cane. The Blue device does not provide for removing the block nor for pivoting the block about the vertical member nor does it provide for utilizing the vertical member as a cane when the block is not being used in its preferred position.

In the present invention a substantially rectangular member is removably attached to a walking stick, preferably a cane, at the lower extremity thereof. The rectangular member is adapted to pivot from a horizontal to a vertical position and in such a way that when in the horizontal position the bottommost portion of the walking stick is higher than the bottommost portion of the block, thereby allowing the greatest amount of stability to the user.

When the rectangular member is not being used in its preferred position, it is pivoted to a vertical position and maintained in this position by a controllable clamp. With the block in the vertical position, the bottommost portion of the walking stick is exposed, thereby allowing the user to use the walking stick as a cane and without interference from the rectangular member.

Further objects and advantages of the present invention will be made more apparent by referring now to the accompanying drawings wherein.

Figure 1:
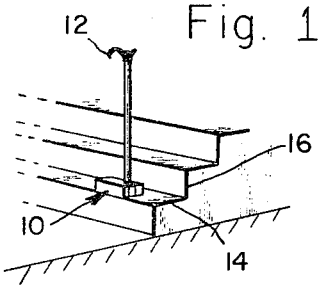
FIG. 1 is a perspective drawing illustrating the walking stick and block as an assisting device to climb steps.

Referring now to FIG. 1, there is shown a pictorial representation of the stepping block 10 attached to the lowermost portion of the cane 12 and with the stepping block 10 in the horizontal position on a step 14.

Figure 7:
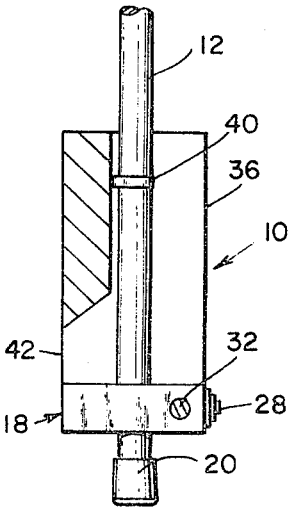
FIG. 7 is a partial section of the step assisting device showing the stepping block in the vertical position.

In the preferred embodiment the stepping block 10 is pivotably attached to the lowermost portion of the walking stick 12 thereby allowing the user to use the walking stick in the preferred position as a cane when the use of the stepping block is not required. In this configuration the pivotable stepping block 10 is pivoted to a vertical position as illustrated in FIG. 7.

The height of the stepping block 10 is preferably one-half the height of the riser 16 associated with the step 14. In this position the user simply flicks the stepping block 10 to the horizontal position, places the walking stick 12 on the step 14, and then places his foot on top of the stepping block 10. The other foot of the user is then placed on the next step and in this way the user can either walk up or down a flight of steps and the distance between each step is now half the height of the riser 16 by means of the stepping block 10.

The advantages of attaching the stepping block to the bottommost portion of the cane 12 will be apparent when it is remembered that the user, being a person of limited mobility, cannot bend down to pick up the stepping block 10 when either climbing or descending the flight of steps. Attaching the stepping block 10 to the cane 12 allows the user to bring the stepping block with him after it has served its purpose whether he is rising or descending the flight of steps and to rotate the stepping block 10 into the vertical position when again on the horizontal level.

In the preferred position the stepping block 10 while adapted to pivot about the lowermost portion of the walking cane 12 does not actually pivot through the cane 12 itself since in the preferred position it is desired that the bottommost portion of the stepping block 10 be lower than the bottommost portion of the cane 12 with the stepping block in the horizontal position and higher than the bottommost position of the cane 12 with the stepping block in the vertical position. It is also desired that the stepping block 10 be adaptable for use with any walking stick 12 and, hence, in the preferred position it is desired that the lowermost portion of the walking stick 12 not be deformed by means of a hole or other pivotable nature.

Figure 2:
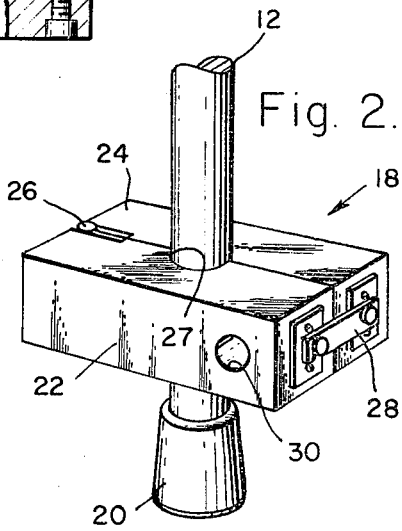
FIG. 2 illustrates a pair of bifurcated blocks in position on the walking cane.

Referring now to FIG. 2, there is shown a pair of bifurcated blocks 18 adapted to frictionally engage the bottommost portion of a walking stick 12. In the preferred embodiment the walking stick 12 is a cane having a conventional rubber tip 20 located on the bottommost portion thereof.

Figure 3:
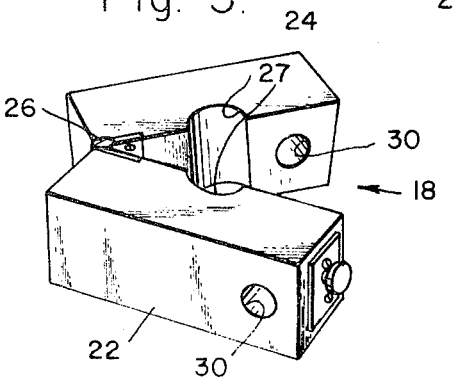
FIG. 3 illustrates a pair of bifurcated blocks for encompassing the walking stick.

The bifurcated blocks 18 are more fully illustrated in FIG. 3 and contain a first and second block 22 and 24 pivoted together at one end by means of a hinge 26. The centermost portion of the blocks 22 and 24 contain a cutout 27 adapted to conform to the external shape of the cane 12.

The opposite end of the blocks 22 and 24 contain a latch mechanism 28 adapted to lock blocks 22 and 24 togther while frictionally engaging the bottommost portion of the cane 12.

The bifurcated blocks 18 may therefore be located in any position on the lowermost portion of the cane 12 and preferably in a position determined by the height of the stepping block 10 since in the preferred embodiment the stepping block 10 when in the horizontal position must be lower than the bottommost portion of the cane 12 as evidenced by the tip 20.

The latch 28 when in the locked position places the opposing blocks 22 and 24 in a frictionally engaging position with the cane 12 and releasing the latch 28 allows the opposing blocks 22 and 24 to be moved either in an upward or in a lower position as determined by the needs of the user.

A through opening 30 extending through block 22 and 24 is located on one side of the cane 12 and may be located on either end of the blocks 22 and 24. In the preferred embodiment the through opening 30 is located on the same end as the latching device 28.

Figure 4:
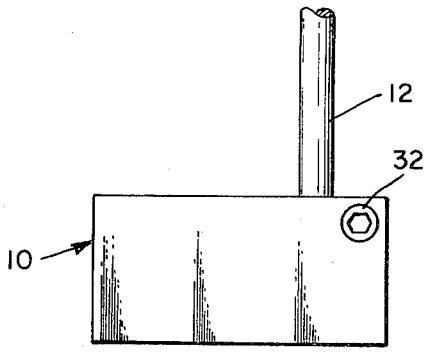
FIG. 4 is a side view of the complete step assisting device illustrating the stepping block.

Referring now to FIG. 4, there is shown a side view of the stepping block 10 pivotably attached to the walking cane 12. The pivotal attachment is occasioned by means of a through bolt 32 located in one corner of the stepping block 10 and adapted to coincide with the through opening 30 located in blocks 22 and 24 as illustrated in FIG. 2. In this manner the stepping block 10 is pivotably attached to the lowermost portion of the cane 12 but without penetrating the cane 12 or requiring a through opening or disfigurement of the cane itself. In actuality the stepping block 10 actually pivots about the bifurcated blocks 18.

The height of the stepping block 10 is approximately one-half the height of the riser 16 as illustrated in FIG. 1 and for the average step this is approximately 3 to 4 inches. The distance of the through opening 30 located on blocks 22 and 24 as illustrated in FIGS. 2 and 3, is therefore positioned from the tip of the cane 20 so as to place the bottommost portion of the stepping block below the tip 20.

Figure 5:
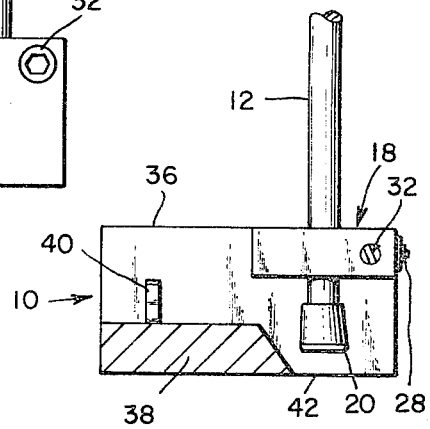
FIG. 5 is a partial sectional view of FIG. 4 with half of the stepping block removed.

Referring now to FIG. 5, there is shown a partial cross-section of the stepping block 10 while in the horizontal position about the cane 12. FIG. 5 shows the bifurcated blocks 18 frictionally engaged to the bottommost portion of the cane 12 while held in this position by latch 28. The stepping block 10 is pivoted about the pivotable member 32 located in opening 30 extending through blocks 22 and 24 as illustrated in FIG. 2.

In the preferred embodiment the stepping block 10 is bifurcated and consists of a first block 34 and a second block 36 as more fully illustrated in connection with FIG. 6.

Bifurcated blocks 34 and 36 are connected together by means of a bracket 38. The space between blocks 34 and 36 contains a clip 40 attached to bracket 38 and which is adapted to clip on to the periphery of cane 12 when the stepping block 10 is in the vertical position as shown in connection with FIG. 7.

As shown in FIG. 5, bifurcated block 18 is positioned on the shank of the cane 12 so that the bottommost portion 42 of the stepping block 10 is lower than the tip 20 of the cane 12.

Figure 6:
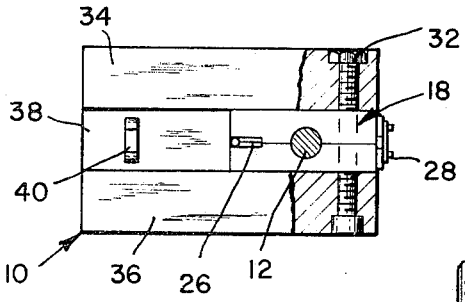
FIG. 6 is a partial plan view of the step assisting device.

FIG. 6 is a partial sectional view of the block 10 more fully illustrating the bifurcated stepping block 10 comprised of blocks 34 and 36 connected together by means of bracket 38. It will be appreciated therefore that the user simply places his foot on the uppermost portion of blocks 34 and 38 when attempting to traverse steps in either a descending or ascending manner.

Referring now to FIG. 7, there is shown a partial sectional view of the stepping block 10 in the vertical position with clip 40 holding the shank of the cane 12 thereby keeping the stepping block out of the way of the user when the cane 12 is used as a cane.

In this view it will be apparent that the complete assembly may be positioned on the lowermost portion of the cane 12 by means of latch 28 which connects blocks 22 and 24 to the cane so that the lowermost portion of the stepping block 10 when in the vertical position is higher than the tip 20 attached to the cane 12.

Upon review it will be apparent that the height of the stepping block 10 may be made any dimension since the bifurcated blocks 18 may be repositioned on the cane 12 by means of latch 28 thereby placing the bottommost portion of the stepping block 10 in the preferred position.

It will also be appreciated that by placing the through hole 30 in the bifurcated blocks 18 that it is therefore not necessary to mutilate the cane 12 and that the stepping block 10 and assembly may be replaced on any cane 12 and, hence, becomes independent of the kind or type of cane actually used.

I claim:

1. A step assisting device for use with a walking stick comprising:

a substantially rectangular stepping block member removably attached to a walking stick at the lower extremity thereof and adapted to pivot from a horizontal to a vertical position, and said member in a horizontal position being lower than the bottommost position of said walking stick and higher than the lowermost portion when in said vertical position.

2. A step assisting device according to claim 1 in which said member is frictionally attached to said walking stick.

3. A step assisting device according to claim 1 in which said member is held in said vertical position by a controllable clamp device.

4. A step assisting device for use with a walking stick comprising:

a first block member frictionally attached to a walking stick at the lower extremity thereof and having a through opening on one side whereby the walking stick is not penetrated, a bifurcated stepping block encompassing said first block member and pivotably attached to said first block member about said through opening, said stepping block pivoting from a vertical position that exposes the bottommost portion of said walking stick to a horizontal position that covers the bottommost portion of said walking stick.

5. A step assisting device according to claim 4 in which said first block comprises two rectangular members having a common central cutout to accept said walking stick and are pivoted together at one end and contain a latch at the other end to frictionally attach the block to said walking stick at any selected location on the stick.

6. A step assisting device according to claim 4 in which the bifurcated stepping block member contains a controllable clamp for holding said block in the vertical position against said walking stick.

7. A step assisting device according to claim 4 in which the height of said stepping block is substantially one-half the height of the average step riser.

* * * * *